United States Patent [19]

Harabedian

[11] Patent Number: 4,915,269

[45] Date of Patent: Apr. 10, 1990

[54] BOTTOM POURING TUBE FOR STEEL PROCESSING

[76] Inventor: John K. Harabedian, 3600 Ridge Park Blvd., Broadview Hts., Ohio 44147

[21] Appl. No.: 240,521

[22] Filed: Sep. 6, 1988

[51] Int. Cl.[4] ..... B22D 41/00

[52] U.S. Cl. ..... 222/590; 222/591

[58] Field of Search ..... 222/590, 591, 606, 607; 226/280, 286, 236

[56] References Cited

U.S. PATENT DOCUMENTS

| | | | |
|---|---|---|---|
| 3,044,499 | 7/1962 | Frerich | 222/591 |
| 3,534,949 | 10/1970 | Mayer et al. | 222/591 |
| 4,142,555 | 3/1979 | Satake et al. | 266/280 |
| 4,506,813 | 3/1985 | Dughan et al. | 222/590 |

*Primary Examiner*—S. Kastler

*Attorney, Agent, or Firm*—Renner, Kenner, Greive, Bobak, Taylor & Weber

[57] ABSTRACT

A unitary cylindrical sleeve is provided for receipt in a trumpet or flumme for use in bottom pouring steel processing operations. The ceramic sleeve includes an inner tubular metallic or plastic shell which receives on the outside thereof a ceramic outer shell. The ceramic sleeve is deposited into and temporarily supported within the trumpet. The combination of trumpet and sleeve is then maneuvered over a receiving spider on a sprue plate of an ingot mold system. Operators need only engage the combination when lowered into close proximity with the sprue plate.

11 Claims, 3 Drawing Sheets

BOTTOM POURING TUBE FOR STEEL PROCESSING

TECHNICAL FIELD

The invention herein resides in the art of steel processing methods and apparatus. More particularly, the invention relates to the pouring of molten steel to form ingots using the bottom pouring or bottom "teeming" technique in which steel is poured down a ceramic sleeve through a network of horizontal ceramics and then upward into the bottoms of molds in which the ingots are formed. Specifically, the invention relates to a novel sleeve design and accompanying process for positioning the sleeves in association with the ingot molds.

BACKGROUND ART

Heretofore various techniques for pouring and forming steel ingots have been known. The prior art has particularly taught the bottom pouring or "teeming" method in which a stack of individual pouring shrouds or sleeves are positioned within a housing or "trumpet" and maintained upon a sprue plate communicating with the ingot molds. In the prior art, the traditional method of effecting the pouring operation has required the preliminary stacking and taping together of various sections of ceramic pouring sleeves to obtain the desired height for receipt by the trumpet or flumme. Once the stack of sleeves has been so assembled, generally on the order of ten feet in height, a crane is then used to lower the trumpet onto the stack of sleeves such that the stack is received by the trumpet. The use of an overhead crane is employed for this operation, it being understood that the trumpet, typically of cast iron, weighs on the order of seven tons.

The prior art technique and structure are characterized by inherent shortcomings. To begin with, the technique is extremely dangerous. Workers are required to manually guide the assembled stack while directing the seven-ton trumpet over it. This manual intervention continues as the trumpet is lowered over the stack. Typically, this lowering operation transcends some ten feet, the stack being comprised of ten to twelve sleeves, each being on the order of a foot in length.

The prior art technique also results in the costly loss of sleeves which occur when the trumpet strikes the stack, resulting in certain destruction of many of the sleeves. Following such an accident, time and labor are required to clean-up and reset the stack.

Further, by constructing the stack of a plurality of independent ceramic sleeves, the operation of the prior art is labor intensive. Accordingly, not only is the erection of the stack costly, but delays in the pouring operation are consequently experienced.

There has been found to be a need in the art for a technique and apparatus overcoming the shortcomings set forth above. Particularly, a need has arisen to eliminate the danger and inherent cost factors characteristic of the prior art technique and apparatus.

DISCLOSURE OF INVENTION

In light of the foregoing, it is a first aspect of the invention to provide a bottom pouring technique and apparatus for steel processing which eliminates the danger of the prior art.

A further aspect of the invention is the provision of a technique and apparatus for bottom pouring steel processing which reduces the cost of sleeve loss occurring when the trumpet strikes the stack.

Another aspect of the invention is the provision of a technique and apparatus for bottom pouring steel processing which eliminates the time and labor costs required not only in the initial erection of the sleeve and marriage of the same to the trumpet, but also which is inevitable when the stack is damaged by contact with the trumpet.

Yet a further aspect of the invention is the provision of a technique and apparatus for bottom pouring steel processing which is easy to implement with state-of-the-art apparatus, and inexpensive to implement, and reliable in operation.

The foregoing and other aspects of the invention which will become apparent as the detailed description proceeds are achieved by an apparatus for bottom pouring steel processing, comprising: a metallic inner shell; a ceramic outer shell encompassing said inner shell, said ceramic outer shell being of unitary construction and wherein said inner and outer shells are bonded to each other.

Other aspects of the invention which will become apparent are achieved by a method of erecting a pouring stack for a metal pouring process, comprising the steps of: lifting and positioning a tubular ceramic member above a trumpet; lowering said tubular ceramic member into said trumpet; and temporarily supporting said tubular member by said trumpet, thereby maintaining said tubular member within said trumpet.

DESCRIPTION OF DRAWINGS

For a complete understanding of the objects, technique and structure of the invention, reference should be had to the following detailed description and accompanying drawing wherein.

BEST MODE FOR CARRYING OUT THE INVENTION

Figure 1:
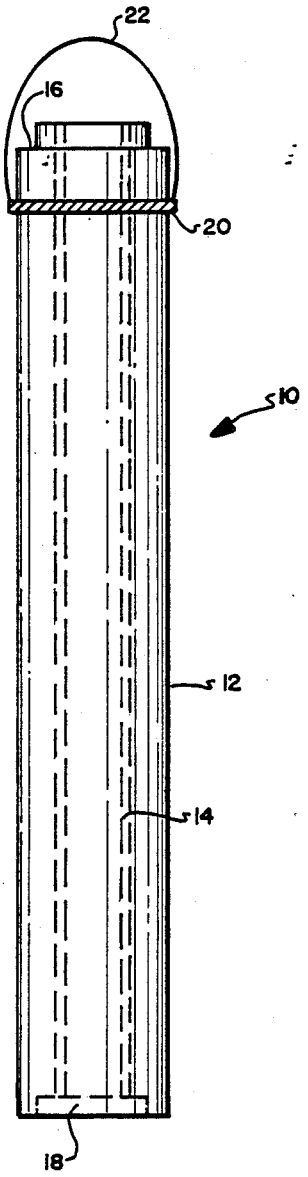
FIG. 1 is a front plan view of a cylindrical ceramic sleeve according to the invention.

Referring now to the drawings, and more particularly FIG. 1, it can be seen that a cylindrical sleeve according to the invention is designated generally by the numeral 10. To accommodate the general pouring technique of the prior art, the cylindrical sleeve 10 is on the order of ten feet in length, although any suitable length could be employed. It will specifically be noted that the sleeve 10 is of unitary construction, not formed from a plurality of independent and interconnected shroud sections. The sleeve 10 is characterized by a ceramic outer shell 12 which may be made of any suitable ceramic material such as boron carbide, silicon carbide, or aluminum oxide. Of course, any of numerous other materials might be employed for the outer shell 12 if the same are of sufficient heat resistive and thermal shock resistive characteristics to be so employed. Typically, the outer shell 12 is on the order of 7 inches in diameter, but such may vary dependent upon the trumpet size. A metallic inner shell 14 is also provided. Preferably, this shell is of metal similar to that which is to be poured, most typically steel. It will be understood that this metallic shell 14, cylindrical in nature, is employed in the manufacturing process of the assembly 10 and provides the base core about which the ceramic outer shell 12 is applied. Accordingly, the shells 12,14 are bonded to each other to define a tubular sleeve 10. it will be appreciated by those skilled in the art that, during a molten steel pouring operation, the metallic inner shell 14 will actually melt away and be deposited into the ingot molds such that only the ceramic outer shell remains. Indeed, the inner shell 14 may be of any consumable material such as plastic. A suitable thickness for the inner shell has been found to be 0.050–0.070 inch when the inner shell is of steel construction.

The cylindrical sleeve 10 is characterized by a shoulder 16 at a top end thereof which is adapted for mating with a funnel or other appropriate member through which the molten steel may be poured. The opposite or bottom end of the sleeve 10 is characterized by a disk-shaped recess for mating with a spider communicating with the ingot molds through the sprue plate. This recess 18 is shown in phantom in FIG. 1. Obviously, the recess 18 may be of any suitable nature to obtain the desired male-female interconnection.

Also shown in FIG. 1 is a band 20 which is clamped, bolted, or otherwise fixedly, yet temporarily, secured about a top end portion of the sleeve 10. In a preferred embodiment, the band may be tensioned within a groove in the top portion of the sleeve 10 if so desired. Extending from diametrically opposed sides of the band 20 is a strap 22 to facilitate handling in a manner which will be discussed hereinafter.

Figure 2:
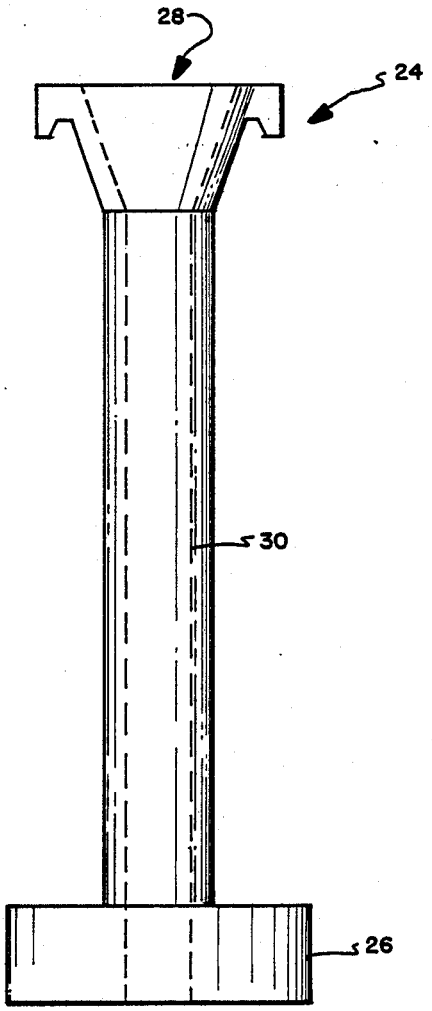
FIG. 2 is a front plan view of the trumpet adapted for receiving and employing the sleeve of FIG. 1.

With reference now to FIG. 2, it can be seen that a trumpet 24, somewhat standard in the art, is provided for receiving the sleeve 10. As is known in the art, the trumpet 24 is made of cast iron and weighs on the order of seven tons. It includes a base 26 which is of a disk-like nature at one end thereof, and a mouth 28 at the opposite end. As shown, the mouth 28 is funnel-shaped to receive the pouring funnel which mates with the shoulder 16 as discussed above. A bore 30 extends from the funnel-shaped mouth 28 through the body of the trumpet 24 and the base 26 thereof as shown in phantom. The bore 30 is of a slightly larger diameter than the outer diameter of the sleeve 10 so as to receive the same therewithin.

Figure 3:
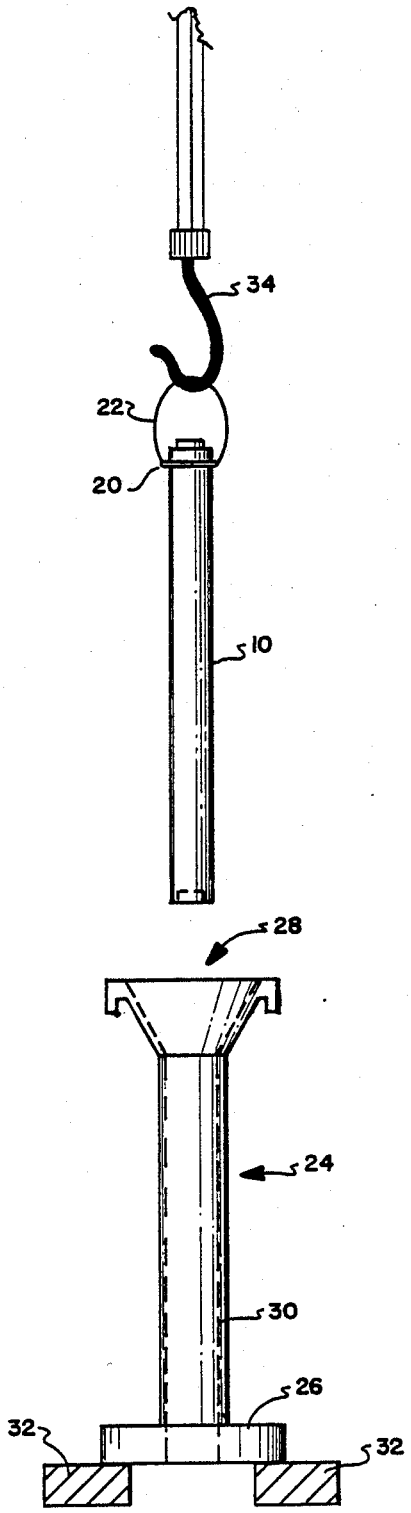
FIG. 3 is an illustrative view of the process of the invention showing the sleeve of FIG. 1 being lowered into the trumpet of FIG. 2.

As shown in FIG. 3, the trumpet is placed upon support blocks 32 or an assembly stand by an appropriate overhead crane or the like. This position provides clearance at the bottom portion of the bore 30 through which a bottom portion of the sleeve 10 may extend in a manner to be discussed hereinafter. As shown in FIG. 3, a crane hook 34 receives the unitary sleeve 10 by means of engagement with the strap 22 and band 20. The crane lifts the sleeve 10 above the flumme or trumpet 24 and then lowers the same into the bore 30. Such positioning can typically be achieved singularly by the crane operator. Even if a worker is required to guide the sleeve 10, the sleeve is of significantly lesser weight than the trumpet 24 and, accordingly, poses a lesser threat to the worker.

Figure 4:
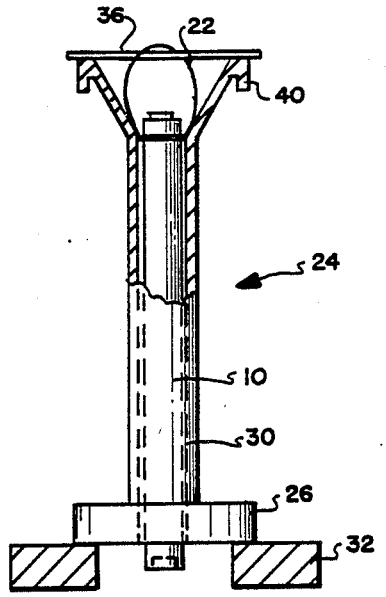
FIG. 4 is an illustrative view of the trumpet of FIG. 2 shown temporarily receiving and supporting the sleeve of FIG. 1.

When the sleeve 10 has been positioned nearly full length into the trumpet 24, a cross piece 36 may be inserted through the strap 22 and supported on either end thereof by the top flange 40 of the mouth 28. The crane hook 34 may then be disengaged from the strap 22. At this point in time, as shown in FIG. 4, the combination of the trumpet 24 and ceramic sleeve 10 are prepared for placement on the sprue plate of the ingot mold and in mating engagement with the spider thereof. As shown, a bottom end portion of the ceramic sleeve 10 extends beyond the bottom of the trumpet 24, making evident the purpose of the support blocks 32.

Figure 5:
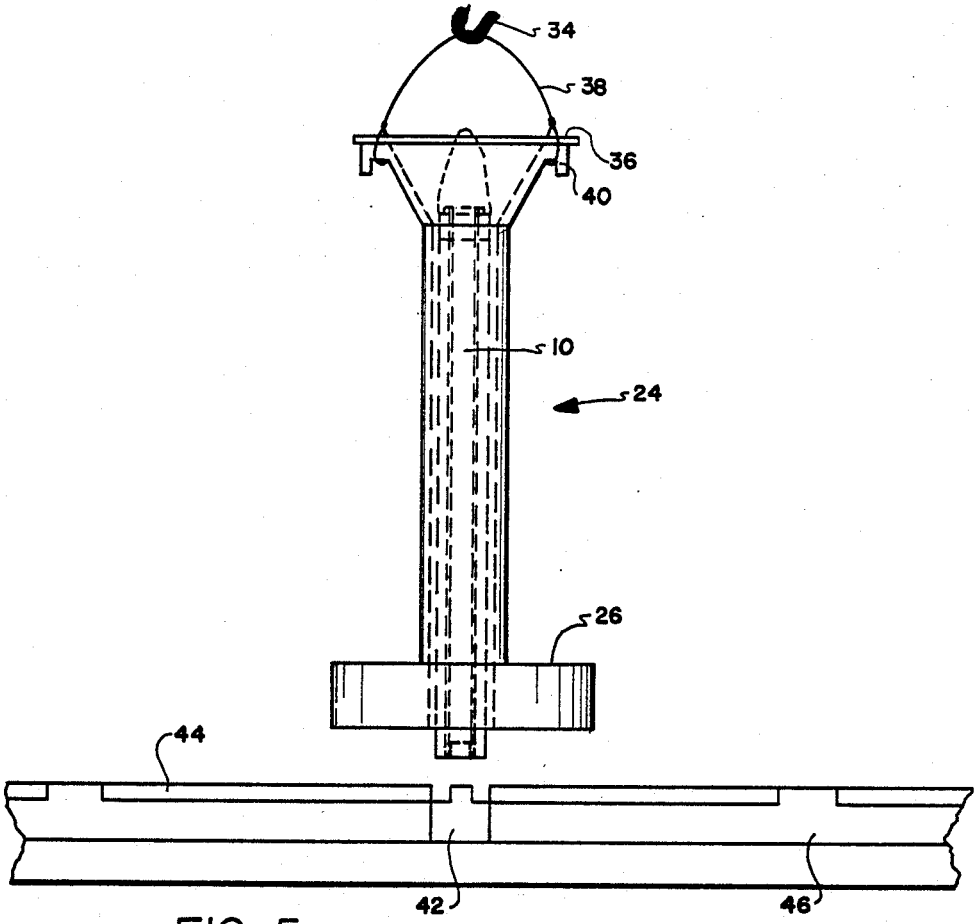
FIG. 5 is an illustrative view of the technique of the invention showing the combination of trumpet and sleeve being lowered onto a sprue plate.
Figure 6:
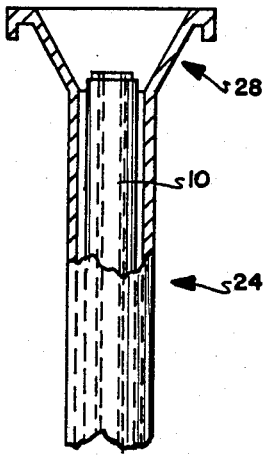
FIG. 6 is a partial sectional view of the trumpet and sleeve combination showing the temporary support structure having been removed.

With reference now to FIG. 5, it can be seen that the crane hook 34 engages a strap 38 which, in turn, is temporarily and appropriately secured to lugs extending from the top flange 40 of the mouth 28. The seven-ton combination may then be lifted by the overhead crane and, by the crane operator alone, brought into close proximity (on the order of a foot or less) of the spider 42 of the sprue plate 44. At this point in time, a worker or workers may make the final mating positioning between the spider 42 and the recess 18 of the cylindrical sleeve 10. The combination is then lowered the remainder of the way and the temporary support pieces 20,22,36,38 may then be removed to leave the structure as shown in FIG. 6. At this point in time, the mating funnel may be engaged with the shoulder 16 of the cylinder 10 and further preparatory operations may commence.

It can thus be seen that the ceramic pouring cylinder of the invention has been structured from a single piece, rather than a plurality of mating shrouds which are interconnected to form a stack. The lighter-weight cylinder 10 is then lowered into the trumpet, rather than the trumpet being lowered over the stack. Danger to workers is significantly reduced and the costs incident to stacking and replacing broken shrouds is substantially eliminated. The inner metallic or plastic shell 14, necessary for fabricating the ceramic sleeve 10, melts away during the pouring operation, leaving only a temperature resistent and thermal shock resistant outer ceramic shell 12.

Thus it can be seen that the objects of the invention have been satisfied by the structure presented hereinabove, while in accordance with the patent statutes, only the best mode and preferred embodiment of the invention has been presented and described in detail, it is to be understood that the invention is not limited thereto or thereby. Accordingly, for an appreciation of the true scope and breadth of the invention, reference should be had to the following claims.

What is claimed is:

1. Apparatus for bottom pouring steel processing, comprising:

an inner shell;

a ceramic outer shell encompassing said inner shell, said ceramic outer shell being of unitary construction and wherein said inner and outer shells are bonded to each other;

first means at a first end of said outer shell for mating with a spider of a sprue plate;

second means at a second end of said outer shell for mating with a funnel; and a clamp with a strap extending therefrom at said second end for temporarily supporting said apparatus within an outer tubular member.

2. The apparatus according to claim 1 wherein said inner shell is metallic.

3. The apparatus according to claim 2 wherein said ceramic outer shell comprises a material selected for the group of boron carbide, aluminum oxide and silicon carbide.

4. The apparatus according to claim 1 wherein said inner shell is plastic.

5. A method of erecting a pouring stack for a metal pouring process, comprising the steps of:

lifting and positioning a tubular ceramic member above a trumpet;

lowering said tubular ceramic member into said trumpet; and temporarily supporting said tubular member by said trumpet, thereby maintaining said tubular member within said trumpet.

6. The method according to claim 5 which further comprises the steps of:

lifting and transporting said trumpet receiving said tubular member into position above a sprue plate;

lowering said trumpet receiving said tubular member onto said sprue plate; and engaging said tubular member with a spider in said sprue plate.

7. The method according to claim 6 which further comprises the step of removing supporting structure engaged between said tubular ceramic member and trumpet.

8. The method according to claim 6 which further comprises the step of human intervention and contact with said trumpet to guide said tubular ceramic member into receiving engagement with said spider when said ceramic tubular member is in close proximity to said spider.

9. The method according to claim 8 wherein said lifting and transporting is achieved by use of an overhead crane.

10. The method according to claim 5 which comprises an initial step of engaging lifting means to said ceramic outer shell.

11. The method according to claim 10 wherein said lifting means comprises a clamp having a strap extending therefrom.

* * * * *